US012168281B2

(12) United States Patent
Leal et al.

(10) Patent No.: US 12,168,281 B2
(45) Date of Patent: Dec. 17, 2024

(54) POLYCRYSTALLINE DIAMOND COMPACT CUTTING ELEMENTS, METHODS OF FORMING SAME AND EARTH-BORING TOOLS

(71) Applicant: Baker Hughes Oilfield Operations LLC, Houston, TX (US)

(72) Inventors: Jair Leal, Spring, TX (US); John A. Bomidi, Spring, TX (US); Aaron Gunn, Tomball, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 447 days.

(21) Appl. No.: 17/647,686

(22) Filed: Jan. 11, 2022

(65) Prior Publication Data

US 2023/0219185 A1 Jul. 13, 2023

(51) Int. Cl.

| | |
|---|---|
| ***B24B 9/16*** | (2006.01) |
| ***B24B 3/33*** | (2006.01) |
| ***B24B 55/06*** | (2006.01) |

(52) U.S. Cl.

CPC ..... *B24B 9/164* (2013.01); *B24B 3/33* (2013.01); *B24B 55/06* (2013.01)

(58) Field of Classification Search

CPC .. B24D 18/009; B24D 18/00; B24D 18/0054; B24D 99/005; B24D 3/10; B24D 3/06;

(Continued)

(56) References Cited

U.S. PATENT DOCUMENTS 3,482,075 A 12/1969 Wilde
3,597,578 A 8/1971 Sullivan et al.

(Continued)

FOREIGN PATENT DOCUMENTS

EP 0352895 A2 1/1990
EP 0541071 A1 5/1993

(Continued)

OTHER PUBLICATIONS

Bokhonov et al, Graphitization of synthetic diamond crystals: A morphological study, Aug. 13, 2021, Graphitization of synthetic diamond crystals: A morphological study, p. 1, (Year: 2021).*

(Continued)

*Primary Examiner* — Robert F Neibaur
(74) *Attorney, Agent, or Firm* — Baker Hughes Company

(57) ABSTRACT

Methods of forming a cutting element include leaching a diamond table of the cutting element and subsequent to leaching the diamond table of the cutting element, forming a chamfer on the diamond table of the cutting element at an interface between a cutting surface of the diamond table and an outer side surface of the diamond table. Methods of forming earth-boring tools include forming a cutting element and securing the cutting element to a body of the earth-boring tool. Forming the cutting element includes including leaching a diamond table of the cutting element and subsequent to leaching the diamond table of the cutting element, forming a chamfer on the diamond table of the cutting element at an interface between a cutting surface of the diamond table and an outer side surface of the diamond table.

20 Claims, 8 Drawing Sheets

(58) Field of Classification Search
CPC .... E21B 10/567; E21B 10/5735; E21B 10/55; B24B 9/164; B24B 3/33; B24B 55/06; B23B 27/12; B23B 27/20; B23B 27/148; B23B 27/145; B23B 2226/315; B23B 2270/28; B28D 5/022; B28D 5/0076
See application file for complete search history.

(56) References Cited

U.S. PATENT DOCUMENTS 3,604,890 A 9/1971 Mullaney et al.
3,749,878 A 7/1973 Sullivan et al.
4,010,345 A 3/1977 Banas et al.
4,498,917 A 2/1985 Weinstein et al.
4,533,815 A 8/1985 Ecer
RE32,036 E 11/1985 Dennis
4,662,708 A 5/1987 Bagdal
4,694,139 A 9/1987 Roeder
4,781,770 A 11/1988 Kar
4,827,947 A 5/1989 Hinz
4,847,112 A 7/1989 Halleux
4,987,800 A 1/1991 Gasan et al.
5,067,250 A 11/1991 Auweiler et al.
5,149,936 A 9/1992 Walton, II
5,149,937 A 9/1992 Babel et al.
5,154,023 A 10/1992 Sioshansi
5,247,923 A 9/1993 Lebourg
5,286,006 A 2/1994 Ogura
5,366,522 A 11/1994 Nakamura et al.
5,447,208 A 9/1995 Lund et al.
5,483,038 A 1/1996 Ota et al.
5,504,303 A 4/1996 Nagy
5,554,415 A 9/1996 Turchan et al.
5,569,399 A 10/1996 Penney et al.
5,582,749 A 12/1996 Mori et al.
5,601,477 A 2/1997 Bunting et al.
5,734,146 A 3/1998 La Rocca
5,742,026 A 4/1998 Dickinson et al.
5,776,220 A 7/1998 Allaire et al.
5,826,772 A 10/1998 Ariglio et al.
5,853,268 A 12/1998 Simpson
5,886,320 A 3/1999 Gallo et al.
5,944,129 A * 8/1999 Jensen ..... E21B 10/5673 175/430
5,962,071 A 10/1999 Reineck et al.
5,965,043 A 10/1999 Noddin et al.
5,967,250 A 10/1999 Lund et al.
6,000,483 A 12/1999 Jurewicz et al.
6,023,040 A 2/2000 Zahavi et al.
6,119,335 A 9/2000 Park et al.
6,204,475 B1 3/2001 Nakata et al.
6,326,588 B1 12/2001 Neubauer et al.
6,353,204 B1 3/2002 Spaay et al.
6,423,928 B1 7/2002 Piwczyk
6,469,729 B1 10/2002 Ryan
6,489,589 B1 12/2002 Alexander
6,521,862 B1 2/2003 Brannon
6,559,413 B1 5/2003 Muenchausen et al.
6,562,698 B2 5/2003 Manor
6,590,181 B2 7/2003 Choo et al.
6,596,225 B1 7/2003 Pope et al.
6,605,798 B1 8/2003 Cullen
6,655,845 B1 12/2003 Pope et al.
6,766,870 B2 7/2004 Overstreet
6,779,951 B1 8/2004 Vale et al.
6,844,521 B2 1/2005 Staufer et al.
6,845,635 B2 1/2005 Watanabe et al.
6,969,822 B2 11/2005 Pollard
7,022,941 B2 4/2006 Joseph et al.
7,065,121 B2 6/2006 Filgas et al.
7,163,875 B2 1/2007 Richerzhagen
7,188,692 B2 3/2007 Lund et al.
7,294,807 B2 11/2007 Callies et al.
7,323,699 B2 1/2008 Hopkins et al.
8,010,224 B2 8/2011 Yamaguchi et al.
8,651,204 B2 2/2014 Webb
8,684,112 B2 * 4/2014 DiGiovanni ..... B24D 18/00 51/307
8,784,517 B1 * 7/2014 Gonzalez ..... B24D 99/005 51/293
8,991,525 B2 3/2015 Bilen et al.
9,259,803 B2 2/2016 DiGiovanni
10,807,913 B1 * 10/2020 Hawks ..... E21B 10/567
2002/0104831 A1 8/2002 Chang et al.
2002/0148819 A1 10/2002 Maruyama et al.
2003/0000928 A1 1/2003 Forlong
2004/0163854 A1 8/2004 Lund et al.
2004/0198028 A1 10/2004 Tanaka et al.
2004/0206734 A1 10/2004 Horsting
2005/0241446 A1 11/2005 Joseph
2006/0043622 A1 3/2006 Kumazawa et al.
2006/0060387 A1 3/2006 Overstreet et al.
2006/0070982 A1 4/2006 Patel
2006/0138097 A1 6/2006 Hiramatsu
2006/0180354 A1 8/2006 Belnap et al.
2006/0247769 A1 11/2006 Molz et al.
2006/0272571 A1 12/2006 Cho

FOREIGN PATENT DOCUMENTS

EP 1844891 A1 10/2007
WO 00/37208 A1 6/2000
WO 2006/038017 A2 4/2006

OTHER PUBLICATIONS

Ascarelli et al., Structural Modifications of Diamond Films Induced by Pulsed Laser Treatment, SPIE, vol. 3404, op. 178-186, 1998.
Chao, C.L., et al., "Investigation of Laser Ablation of CVD Diamond Film", Proc. of SPIE, vol. 5713, pp. 21-28, 2005.
Eder, Kurt, Dies New thoughts on machinery for synthetic PCD die piercing and profiling Wire Journal nternational, pp. 34-40, Dec. 1984.
EP Office Action for EP Application No. 08 847 397 .0 dated Feb. 22, 2011.
Gloor et al., Laser ablation of diamond films in various atmospheres, Diamond and Related Materials, vol. 7, pp. 507-611, 1998.
Harrison et al., Laser Processing of Polycrystalline Diamond, Tungsten Carbide and a Related Composite Material, Journal of Laser Applications, vol. 18, issue 2, pp. 117-126, May 2006.
Harrison, Paul, et al., "Enhanced Culling of Polycrystalline Diamond with a Q-Switched Diode Pumped Solid State Laser", Powerlase Ltd., Paper #202, 8 pages, http://www.powerlase-photonics.com/wp-content/uploads/2011/data-sheets/ICALEO2005_PCDPaper.pdf., 2005.
International Search Report for International Application No. PCT/US2008/082405 mailed May 12, 2010, 5 pages.
International Written Opinion for International Application No. PCT/US2008/082405 mailed May 12, 2010, 7 pages.
Khomich, A.V., et al., "Optical properties of laser-modified diamond surface", SPIE, vol. 3484, pp. 166-174, 1998.
Kim, Yong-Gi, et al., "Microroughness Reduction of Tungsten Films by Laser Polishing Technology with a Line Beam", Japanese Journal of Applied Physics, vol. 43, No. 4A, pp. 1315-1322, 2004.
Kiwus, Ulrich, "Grinding and polishing of diamond wire dies with ultra-hard, ready-made needles and direct ultrasound generators", Wire, vol. 42, pp. 98-99, Feb. 1992.
Kononenko, V.V.., et al., "Control of laser machining of polycrystalline diamond plates by the method of low-coherence optical interferometry", Quantum Electronics, vol. 35, No. 7, pp. 622-626, Jul. 2005.
Konov, V.I., et al., "Laser microprocessing of diamond and diamond-like films", SPIE vol. 2045, pp. 184-192, 1994.
Laguarta et al., Laser application for optical glass polishing, SPIE, vol. 2775, pp. 603-610, 1996.
Levy, Aron, "Drilling, Sawing, and Contouring Industrial and Gem Diamonds by Laser", pp. 223-236, no publication info or dale.
Meijer, J., et al., "Laser Machining by short and ultrashort pulses, state of the art and new opportunities in the age of he photons", 20 pages, CIRP Annals-Manufacturing Technology, 2002.

(56) References Cited

OTHER PUBLICATIONS

Meijer, Johan, "Laser beam machining (LBM), state of the art and new opportunities," Journal of Materials Processing Technology, vol. 149, pp. 2-17, 2004.
Murahara, Masataka, "Excimer Laser-Induced Photochemical Polishing of SiC Mirror", Proc. SPIE, vol. 4679, pp. 69-74, 2002.
Nowak et al., A model for "cold" laser ablation of green state ceramic materials, Appl. Phys. A, vol. 91, pp. 341-348, 2008.
Pimenov, S.M. et al., "Laser Polishing of Diamond Plates", Appl. Phys. A, vol. 69, pp. 81-88, 1999.
Quintero et al., Optimization of an off-axis nozzle for assist gas injection in laser fusion cutting, Optics and Lasers in Engineering, vol. 44, pp. 1158-1171, 2006.
Smith, Maurice, "Drilling & Completions, Culling Edge, PDC Bits Increasingly Displace Roller Cone Bits as Technology Rapidly Evolves", New Technology Magazine, 8 pages, Jan./Feb. 2005.
SPE, "Faster and Longer Bil Runs With New-Generation PDC Cutter", JPT, pp. 73-75, Dec. 2006.
SPE, "New Bil Design and Cutter Technology Extend PDC Applications to Hard-Rock Drilling", JPT, pp. 63-64, Dec. 2005.
Watson et al., Using New Computational Fluid Dynamics Techniques to Improve PDC Bil Performance, SPE/IADC 37580, pp. 91-105, 1997.
Windholz et al., Nanosecond pulsed excimer laser machining of chemical vapour deposited diamond and highly Jrienled pyrolytic graphite, Part I, An experimental investigation Journal of Materials Science, vol. 32, pp. 4295-4301, 1997.
Xu, Feng, et al., "Study on Energy Density Needed in ND:YAG Laser Polishing of CVD Diamond Thick-Film", 7th International Conference on Progress of Machining Technology, pp. 382-387, Dec. 8-11, 2004.
Zhang, G.F., et al., "An Experimental Study on Laser Cutting Mechanisms of Polycrystalline Diamond Compacts," Annals of the CIRP, vol. 56, No. 1, pp. 201-204, 2007.

* cited by examiner

600

| Test Number | Air (PSI) | RPM-Wheel | RPM-Collet | Sa (um) | Sq (um) | Notes |
|---|---|---|---|---|---|---|
| 1 | N/A | 1400 | 503 | 0.09 | 0.11 | N/A |
| 2 | 5 | 1400 | 503 | 0.09 | 0.11 | Air blowing on center of wheel |
| 3 | 5 | 1800 | 503 | 0.05 | 0.07 | Air blowing on center of wheel |
| 4 | 5 | 2440 | 575 | 0.05 | 0.08 | Air blowing on center of wheel |
| 5 | 5 | 2440 | 575 | 0.06 | 0.10 | Part never exits wheel |
| 6 | 5 | 2440 | 575 | 0.04 | 0.06 | Air on the side of wheel, cleans part before reentry |

FIG. 6

POLYCRYSTALLINE DIAMOND COMPACT CUTTING ELEMENTS, METHODS OF FORMING SAME AND EARTH-BORING TOOLS

TECHNICAL FIELD

This disclosure relates generally to cutting elements for earth-boring tools and related earth-boring tools and methods. More specifically, disclosed embodiments relate to techniques for producing a polished chamfer of a polycrystalline diamond cutting element exhibiting a low surface roughness and substantially free of surface defects and earth-boring tools incorporating such cutting elements.

BACKGROUND

Earth boring tools for forming wellbores in subterranean earth formations may include a plurality of cutting elements secured to a body. For example, fixed cutter earth boring rotary drill bits (also referred to as "drag bits") include a plurality of cutting elements that are fixedly attached to a bit body of the drill bit. Similarly, roller cone earth boring rotary drill bits include cones that are mounted on bearing pins extending from legs of a bit body such that each cone is capable of rotating about the bearing pin on which the cone is mounted. A plurality of cutting elements may be mounted to each cone of the drill bit.

The cutting elements used in earth boring tools often include polycrystalline diamond compact (often referred to as "PDC") cutters, which are cutting elements that include a polycrystalline diamond (PCD) material. Such polycrystalline diamond cutting elements are formed by sintering and bonding together relatively small diamond grains or crystals under conditions of high pressure and high temperature, typically in the presence of a catalyst (typically including a Group VIII element, such as cobalt, iron, or nickel, or an alloy or mixture having such elements), to form a layer of polycrystalline diamond material on a cutting element substrate. These processes are often referred to as high-pressure/high-temperature (or "HPHT") processes. Catalyst material is mixed with the diamond grains to reduce the amount of oxidation of diamond by oxygen and carbon dioxide during an HPHT process and to promote diamond to diamond bonding.

The cutting element substrate may include a cermet material (i.e., a ceramic metal composite material) such as cobalt cemented tungsten carbide. In such instances, the cobalt (or other catalyst material) in the cutting element substrate may be drawn into the diamond grains or crystals during sintering and serve as a catalyst material for forming a diamond table from the diamond grains or crystals. In other methods, powdered catalyst material may be mixed with the diamond grains or crystals prior to sintering the grains or crystals together in an HPHT process.

Upon formation of a diamond table using an HPHT process, catalyst material may remain in interstitial spaces between the grains or crystals of diamond in the resulting polycrystalline diamond table. The presence of the catalyst material in the diamond table may contribute to thermal damage in the diamond table when the cutting element is heated during use, due to friction at the contact point between the cutting element and the formation.

Conventional PDC fabrication relies on the catalyst alloy that sweeps through the compacted diamond feed during HPHT synthesis. Traditional catalyst alloys are cobalt based with varying amounts of nickel, tungsten, and chromium to facilitate diamond intergrowth between the compacted diamond material. However, in addition to facilitating the formation of diamond to diamond bonds during HPHT sintering, these alloys also undesirably facilitate the formation of graphite from diamond during drilling. Formation of graphite in the PCD material can rupture diamond necking regions (i.e., grain boundaries) due to an approximate 57% volumetric expansion during the transformation. This phase transformation is known as "back conversion" or "reverse graphitization," and typically occurs at temperatures exceeding 900° C., near cutting element cutting edge temperatures experienced during drilling applications. This mechanism, coupled with mismatch of the coefficients of thermal expansion of the metallic phase and diamond as temperatures exceed 600° C. is believed to account for a significant part of degradation of the general performance criteria known as "thermal stability." From experimental wear conditions, "back conversion" appears to dominate impairment of the thermal stability of a PCD, promoting premature degradation of the cutting edge and performance.

To reduce problems associated with different rates of thermal expansion and with back conversion in polycrystalline diamond cutting elements, so called "thermally stable" polycrystalline diamond (TSD) cutting elements have been developed. A TSD cutting element may be formed by leaching the catalyst material (e.g., cobalt) out from interstitial spaces between the diamond grains in the diamond table using, for example, an acid. Substantially all of the catalyst material may be removed from the diamond table, or only a portion may be removed. TSD cutting elements in which substantially all catalyst material has been leached from the diamond table have been reported to be thermally stable up to temperatures of about 1,200° C. It has also been established, however, that fully leached diamond tables are relatively more brittle and vulnerable to shear, compressive, and tensile stresses than are non-leached diamond tables. In an effort to provide cutting elements having diamond tables that are more thermally stable relative to non-leached diamond tables, but that are also relatively less brittle and vulnerable to shear, compressive, and tensile stresses relative to fully leached diamond tables, cutting elements have been provided that include a diamond table in which only at least a portion of the catalyst material has been leached from the diamond table.

BRIEF SUMMARY

Some embodiments of the present disclosure include a method of forming a cutting element. The method may include leaching at least a portion of a diamond table of the cutting element and, subsequent to leaching the diamond table of the cutting element, forming a chamfer on a leached portion of the diamond table of the cutting element proximate an interface between a cutting surface of the diamond table and an outer side surface of the diamond table.

Additional embodiments include a method of forming a cutting element. The method may include leaching at least a portion of a diamond table and, subsequent to leaching the diamond table, polishing an interface between a cutting surface of the diamond table and an outer side surface of the diamond table to form a chamfer on the diamond table.

Some embodiments of the disclosure include a method of forming an earth-boring tool. The method may include forming a cutting element. Forming the cutting element may include leaching a diamond table of the cutting element and, subsequent to leaching the diamond table of the cutting element, forming a chamfer on the diamond table of the cutting element at an interface between a cutting surface of the diamond table and an outer side surface of the diamond table. The method may also include securing the cutting element to a body of the earth-boring tool.

BRIEF DESCRIPTION OF THE DRAWINGS

For a detailed understanding of the present disclosure, reference should be made to the following detailed description, taken in conjunction with the accompanying drawings, in which like elements have generally been designated with like numerals, and wherein:

FIG. 6 shows a table having results from testing performed by the inventors according to one or more embodiments of the present disclosure;

DETAILED DESCRIPTION

Figure 1:
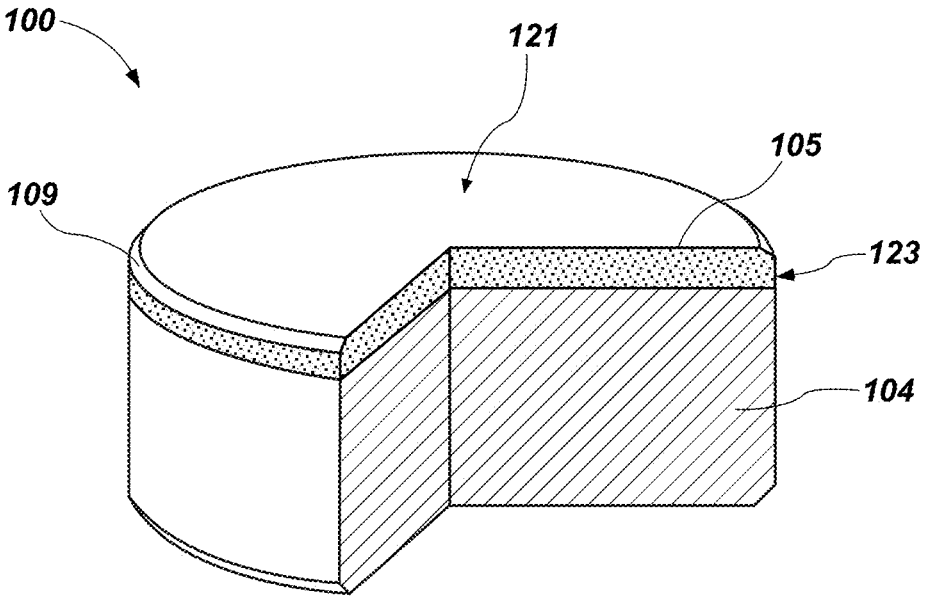
FIG. 1 is a cross-sectional side view of cutting element and polycrystalline hard material according to one or more embodiments of the present disclosure.

The illustrations presented herein are not actual views of any particular cutting elements or earth-boring tools, but are merely idealized representations that are employed to describe example embodiments of the present disclosure. Additionally, elements common between figures may retain the same numerical designation.

As used herein, the term "particle" means and includes any coherent volume of solid matter having an average dimension of about 500 μm or less. Grains (i.e., crystals) and coated grains are types of particles.

As used herein, the term "hard material" means and includes any material having a Knoop hardness value of about 3,000 $Kg_f/mm^2$ (29,420 MPa) or more. Hard materials include, for example, diamond and cubic boron nitride.

As used herein, the term "polycrystalline hard material" means and includes any material comprising a plurality of grains or crystals of the material that are bonded directly together by inter-granular bonds. The crystal structures of the individual grains of polycrystalline hard material may be randomly oriented in space within the polycrystalline hard material.

As used herein, the term "polycrystalline compact" means and includes any structure comprising a polycrystalline hard material comprising inter-granular bonds formed by a process that involves application of pressure (e.g., compaction) to the precursor material or materials used to form the polycrystalline hard material.

Thus, as used herein, the term "leached," when used in relation to a volume of polycrystalline hard material (e.g., a polycrystalline diamond table), means that the volume or at least a region of the volume does not include catalyst material in interstitial spaces between inter-bonded diamond grains, regardless of whether or not catalyst material was removed from that region (by a leaching process or any other removal process). Similarly, as used herein the term "leaching" means and includes removal of a catalyst material from interstitial spaces between inter-bonded diamond grains of a polycrystalline diamond table by any technique, without limitation to acid leaching.

As used herein, the term "earth-boring tool" means and includes any type of bit or tool used for drilling during the formation or enlargement of a wellbore and includes, for example, rotary drill bits, percussion bits, core bits, eccentric bits, bi-center bits, reamers, mills, drag bits, roller-cone bits, hybrid bits, and other drilling bits and tools known in the art.

As used herein, any relational term, such as "first," "second," "front," "back," etc., is used for clarity and convenience in understanding the disclosure and accompanying drawings, and does not connote or depend on any specific preference or order, except where the context clearly indicates otherwise.

As used herein, the terms "comprising," "including," "containing," "characterized by," and grammatical equivalents thereof are inclusive or open-ended terms that do not exclude additional, un-recited elements or method steps, but also include the more restrictive terms "consisting of" "consisting essentially of" and grammatical equivalents thereof.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, the term "configured" refers to a size, shape, material composition, and arrangement of one or more of at least one structure and at least one apparatus facilitating operation of one or more of the structure and the apparatus in a predetermined way.

As used herein, the singular forms following "a," "an," and "the" are intended to include the plural forms as well, unless the context clearly indicates otherwise.

As used herein, the term "and/or" includes any and all combinations of one or more of the associated listed items.

As used herein, the term "substantially" in reference to a given parameter, property, or condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

As used herein, the term "about" used in reference to a given parameter is inclusive of the stated value and has the meaning dictated by the context (e.g., it includes the degree of error associated with measurement of the given parameter).

FIG. 1 depicts a cutting element 100, which may be formed as disclosed herein. The cutting element 100 includes a volume of polycrystalline hard material 105 (e.g., a diamond table). Typically, the polycrystalline hard material 105 may include polycrystalline diamond. Optionally, the cutting element 100 may also include a substrate 104 to which the polycrystalline hard material 105 may be bonded, or on which the polycrystalline hard material 105 may be formed under the aforementioned HPHT conditions. For example, the substrate 104 may include a generally cylindrical body of cobalt-cemented tungsten carbide material, although substrates of different geometries and compositions may also be employed. As noted above, the polycrystalline hard material 105 may be in the form of a table (i.e., a layer) of polycrystalline hard material 105 on the substrate 104, as shown in FIG. 1. The polycrystalline hard material 105 may be provided on (e.g., formed on or secured to) a surface of the substrate 104. In additional embodiments, the cutting element 100 may simply be a volume of the polycrystalline hard material 105 having any desirable shape, and may not include any substrate 104. The cutting element 100 may be referred to as "polycrystalline compact," or, if the polycrystalline hard material 105 includes diamond, as a "polycrystalline diamond compact."

The polycrystalline hard material 105 may have exposed surfaces, such as a cutting face 121, a side surface 123, and a chamfer 109. The cutting face 121 may be substantially planar, or may have any other selected shape. The side surface 123 may be substantially cylindrical, or any other selected shape. For example, in some embodiments, the side surface 123 may include a plurality of planar surfaces circumscribing the cutting element 100. The shape and angle of the chamfer 109 may be selected to improve performance of the cutting element 100.

Furthermore, as is described in greater detail below, the polycrystalline hard material 105 may include a leached material. For example, at least a portion of the polycrystalline hard material 105 may be substantially free of a catalyst material. Moreover, as is discussed in greater detail below, the chamfer 109 may be formed post any leaching processes.

Figure 2:
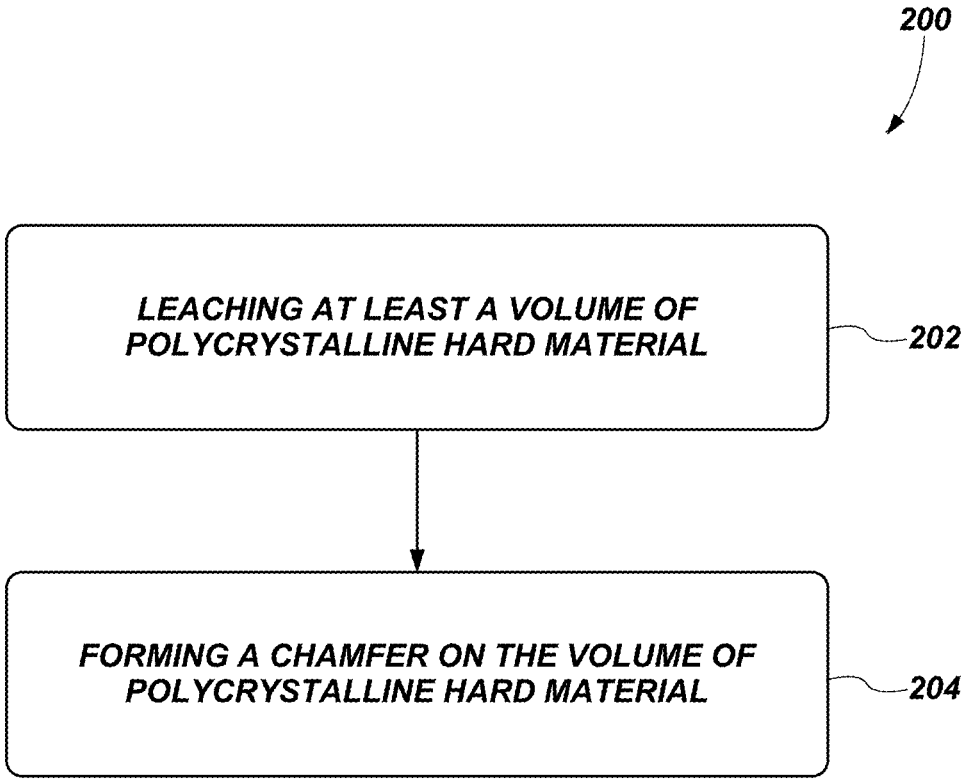
FIG. 2 is a flow chart of a method for forming cutting elements according to one or more embodiments of the present disclosure.

FIG. 2 shows a flow chart of a method 200 for forming a cutting element 100 according to one or more embodiments of the present disclosure. In some embodiments, the method 200 may include leaching a volume of polycrystalline hard material 105 (e.g., a diamond table), as shown in act 202. For example, the method 200 may include leaching a polycrystalline diamond compact formed from the polycrystalline hard material 105. Leaching the polycrystalline hard material 105 may include removing a catalyst (e.g., metal solvent catalyst (e.g., cobalt)) from the polycrystalline hard material 105 via one or more of hot-acid leaching, vacuum leaching, electrolytic removal processes, or any other conventional leaching process.

For example, leaching the polycrystalline hard material 105 may include leaching the catalyst material out from interstitial spaces between inter bonded diamond crystals in the polycrystalline hard material 105 using leaching agent such as, for example, an acid or combination of acids (e.g., aqua regia). A substantial amount of the catalyst material may be removed from the polycrystalline hard material 105, or catalyst material may be removed from only a portion thereof. Thermally stable polycrystalline hard materials in which substantially all catalyst materials have been leached out from the polycrystalline hard materials may be thermally stable up to temperatures of about twelve hundred degrees Celsius (1,200° C.). In view of the foregoing, the polycrystalline hard material 105 may be leached via any conventional process.

Figure 3A:
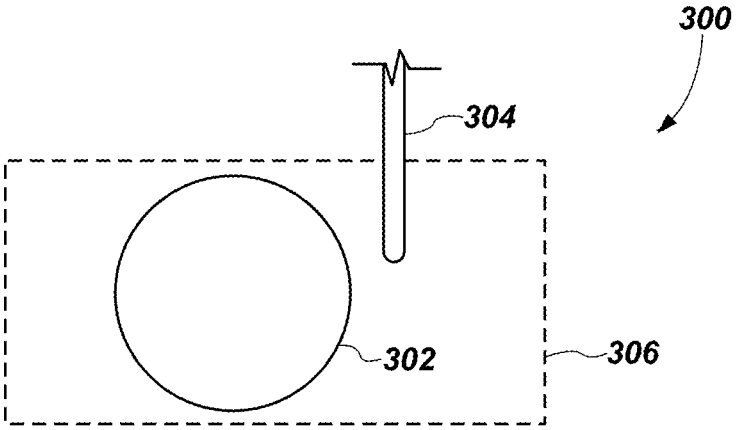
FIGS. 3A and 3B show schematic representations of a chamfer forming system according to one or more embodiments of the present disclosure.
Figure 3B:
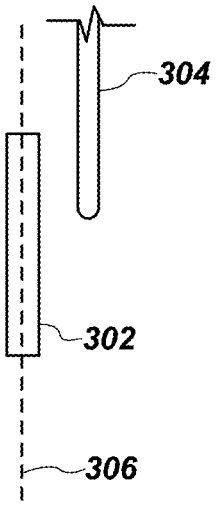

The method 200 may further include forming a chamfer 109 on the volume of polycrystalline hard material 105 subsequent to leaching the volume of polycrystalline hard material 105, as shown in act 204 of FIG. 2. FIGS. 3A and 3B show schematic representations of a chamfer forming system 300 according to one or more embodiments of the present disclosure. Referring to FIGS. 2-3B together, the chamfer forming system 300 may include polishing element 302 and an air nozzle 304.

In some embodiments, the air nozzle 304 may be spaced apart from the polishing element 302 and may be offset from the polishing element 302. For example, the air nozzle 304 may be offset from a center plane 306 centered between lateral sides of the polishing element 302 (e.g., lateral side surfaces of the polishing wheel). As a result, when a part being polished is removed from contact with the polishing element 302, a polished portion of the part may be exposed to airflow from the air nozzle 304. In additional embodiments, the air nozzle 304 may be aligned with the polishing element 302. For example, the air nozzle 304 may be centered on the center plane 306 centered between the lateral sides of the polishing element 302. As a result, the polishing element 302 may be at least partially cooled during polishing processes.

In some embodiments, the polishing element 302 may include a polishing and/or grinding wheel. For example, the polishing element 302 may include a resin bonded, diamond wheel having a grit size of D220 per 3M specification. The air nozzle 304 may include a tube coupled to an air source (e.g., a compressor) and having an opening for directing airflow. The air nozzle 304 may be configured to provide airflow resulting from air pressure within a range of between about 2.0 psi and about 8.0 psi. For example, the air nozzle 304 may be configured to provide airflow resulting from air pressure of about 5.0 psi.

Referring still to FIGS. 2-3B, forming the chamfer 109 on the polycrystalline hard material 105 subsequent to leaching the polycrystalline hard material 105 (act 204) may include subjecting the polycrystalline hard material 105 to contact with the polishing element 302 (e.g., engaging the polycrystalline hard material 105 with the polishing element) and polishing/grinding an edge of the polycrystalline hard material 105 to form the chamfer 109. In some embodiments, the polycrystalline hard material 105 may be secured within a collet (e.g., band or sleeve) during polishing/grinding processes.

In some embodiments, the polishing element 302 may be rotated at a rotations-per-minute (RPM) within a range of between about 2200 RPM and about 3200 RPM. For example, in some embodiments, the polishing element 302 may be rotated at about 2800 RPM. In other embodiments, the polishing element 302 may be rotated at about 2400 RPM. In some embodiments, the collet and the polycrystalline hard material 105 may also be rotated during polishing/grinding processes. For example, the collet and the polycrystalline hard material 105 may be rotated within a range of about 300 RPM and 700 RPM. For instance, the collet and the polycrystalline hard material 105 may be rotated at about 575 RPM.

In some embodiments, while forming the chamfer 109, the polycrystalline hard material 105 may be polished/ground until at least a portion of the diamond particles within the polycrystalline hard material 105 are overheated and graphitized. Subsequently, at least the polished/grinded portion the polycrystalline hard material 105 may be subjected to airflow from the air nozzle 304 to at least substantially remove the graphitized diamond particles. In some embodiments, the polycrystalline hard material 105 may be subjected to airflow from the air nozzle 304 for a time period within a range of between about 0.1 seconds and about 2.0 second. For example, the polycrystalline hard material 105 may be subjected to airflow from the air nozzle 304 for about 0.5 seconds prior to being returned to the polishing element 302. Furthermore, the acts of polishing/grinding the polycrystalline hard material 105 and removing graphitized diamond particles (i.e., graphite) via airflow may be repeated until the chamfer 109 is formed.

In some embodiments, forming the chamfer 109 on the polycrystalline hard material 105 may include a dry polishing process. In other words, forming the chamfer 109 on the polycrystalline hard material 105 may not include using a liquid coolant.

Referring still to FIGS. 2-3B together, while forming a chamfer 109 is described in detail herein, the disclosure is not so limited. For example, embodiments of the present disclosure include forming any features within a polycrystalline hard material 105 via polishing/grinding processes. For instance, embodiments of the present disclosure include forming recesses, apertures, divots, pockets, or any other void within the polycrystalline hard material 105 via the methods and systems described herein.

Figure 4:
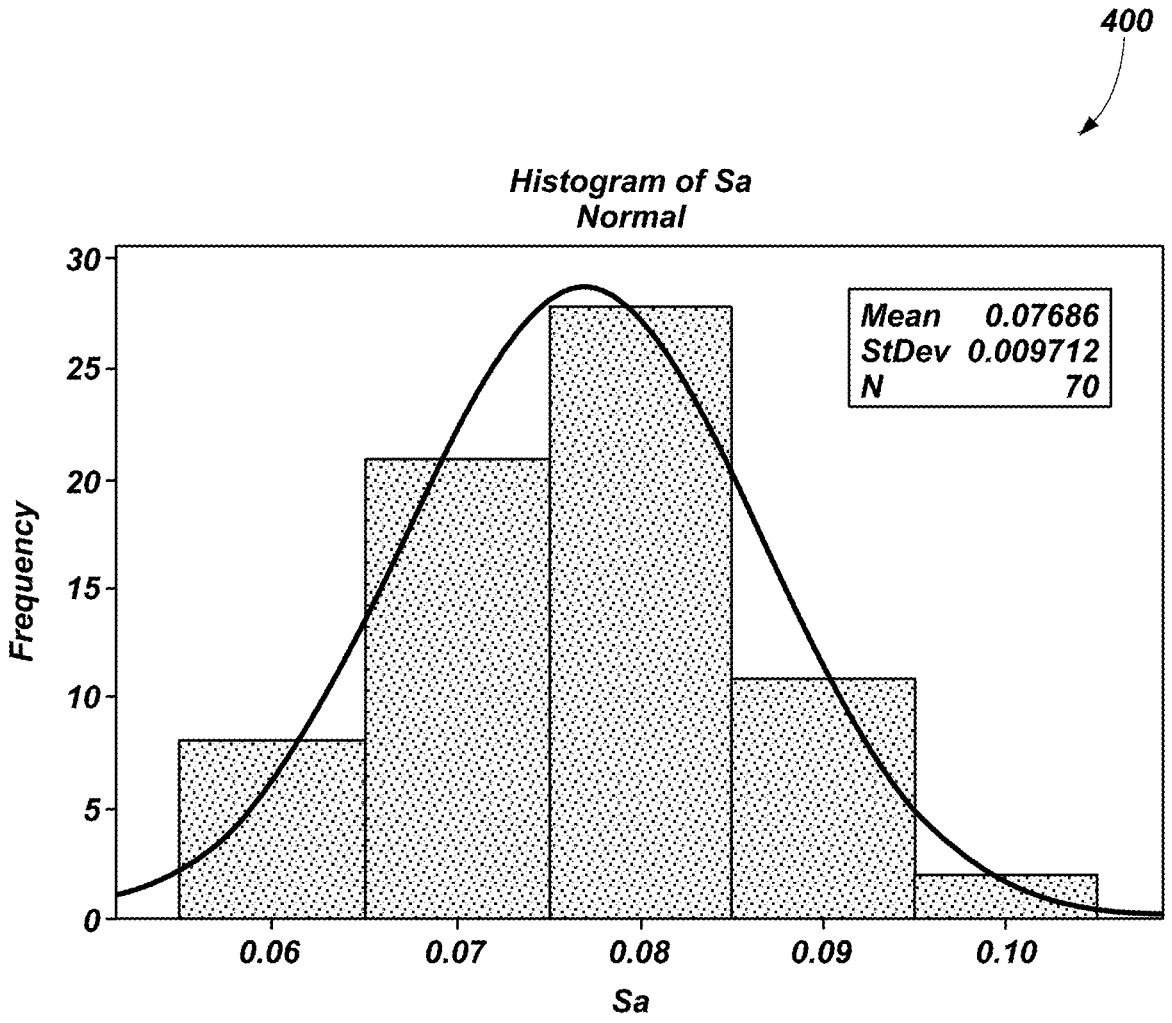
FIG. 4 shows a bar graph of roughness averages (Sa) on a surface of a cutting element after the surface has been polished according to methods described herein.
Figure 5:
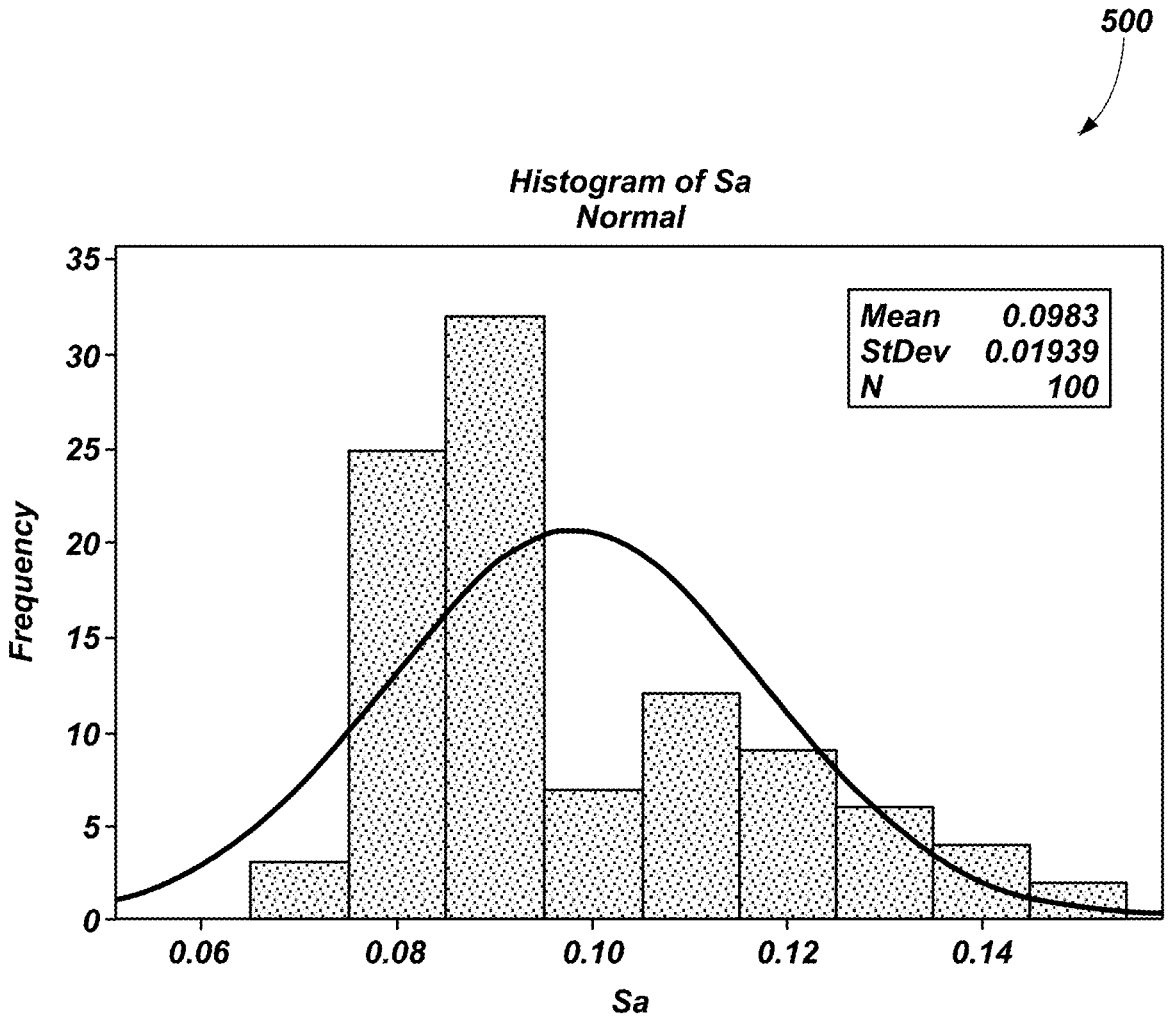
FIG. 5 shows a bar graph of roughness averages (Sa) on a surface after being polished according to methods described herein.
Figure 8:
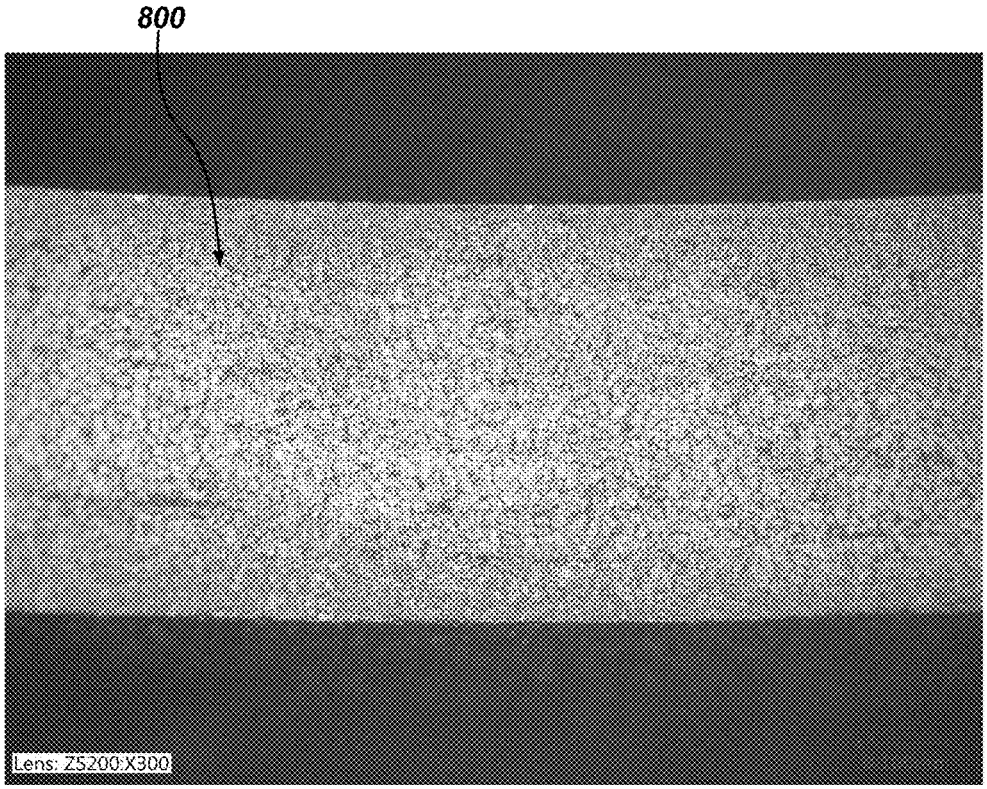
FIGS. 8 and 9 show a comparison of surfaces with one being formed via the methods and processes described herein.
Figure 9:
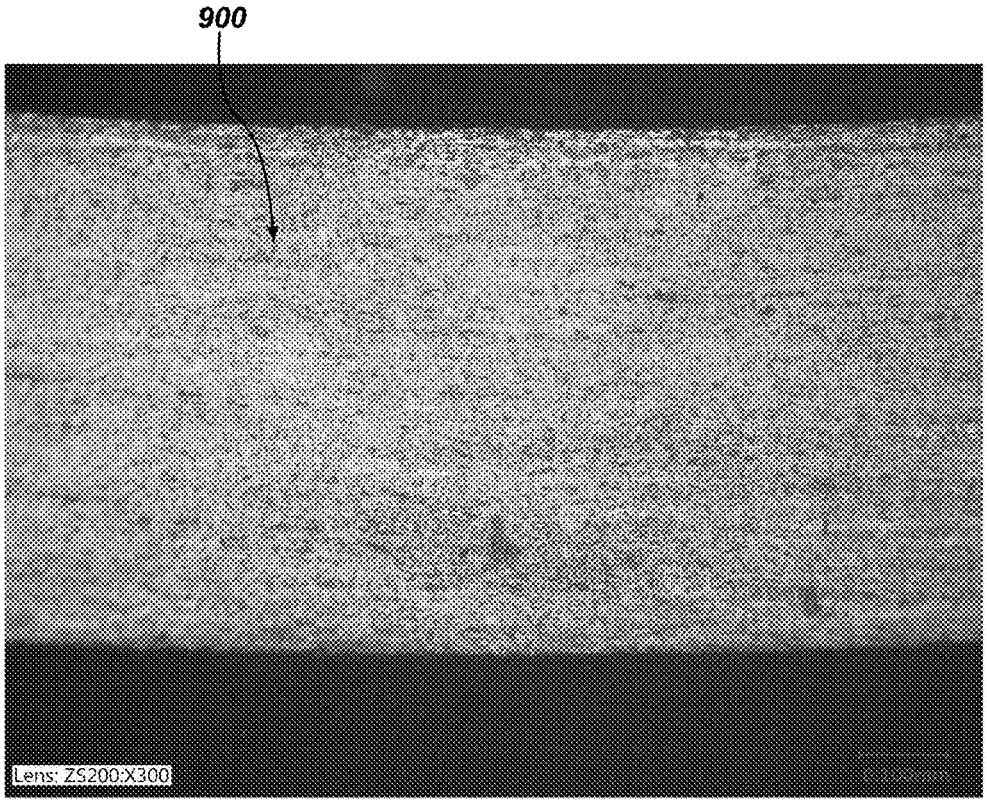

In experiments performed by the inventors, it was determined that providing airflow directly onto the part being polished yielded smoother surfaces (e.g., lower roughness averages) in comparison to providing airflow directly onto the polishing element 302. FIG. 4 shows a bar graph 400 of roughness averages (Sa) on a surface after being polished according to the methods described herein and having airflow directed onto the part between polishing sessions. FIG. 5 shows a bar graph 500 of roughness averages (arithmetical mean height (Sa)) on a surface after being polished and having airflow directed onto the polishing element 302. As shown, the roughness averages (Sa) are significantly lower when the airflow is directed onto the part being polished relative to when the airflow is directed onto the polishing element 302. FIG. 8 shows a surface 800 of a chamfer where leaching was performed after the chamfer was formed. As shown, boundaries of grains are apparent, which increase surface roughness and are undesirable. FIG. 9 shows a surface 900 of a chamfer where leaching was performed prior to the chamfer being formed. As shown, the boundaries of the grains are not visible, and the surface is smoother than the surface depicted in FIG. 8.

FIG. 6 shows a table 600 having additional results from testing performed by the inventors. As shown in FIG. 6, six tests were performed with a polishing wheel rotating at various RPMs and a collet holding the diamond table rotating at various RPMs. Furthermore, in some tests, air was directed on a center of the polishing wheel, and in others, air was oriented to a side of the polishing wheel and was directed onto the part before reengaging the polishing wheel (e.g., before reentry into the polishing wheel). As shown in FIG. 6, the best results (e.g., lowest surface roughnesses (Sa) and (root mean square height (Sq)) were achieved when the air source was oriented on a side of the polishing wheel and was used to clean the part prior to reengaging the polishing wheel.

Referring to FIGS. 1-6 together, the methods and systems described herein for forming chamfers on diamond tables for cutting elements provide advantages over conventional methods and systems. For example, in comparison to conventional methods that include forming the chamfer prior to leaching the diamond table, which can cause defects (e.g., surface defects) in the chamfer, the methods and systems described herein provide a substantially defect (e.g., surface defect) free and highly polished chamfer (e.g., a chamfer having a relatively low average surface roughness) the diamond table. Reducing defects in the chamfer and reducing a surface roughness may improve an effectiveness of the chamfer and may improve an integrity of the chamfer and the cutting table. Improving an effectiveness of the chamfer and an integrity of the chamfer and the cutting table may increase a lifespan of the respective cutting element which reduces costs and downtime.

Referring still to FIGS. 1-6 together, the methods and systems described herein for forming chamfers on diamond tables for cutting elements may decrease an average surface roughness of a given chamfer by more than half (e.g., from 0.97 (arithmetic average of the absolute values of the profile height deviations from the mean line (Ra)) to about 0.44 Ra). Moreover, by forming the chamfer after a leaching process, the methods and systems described herein may provide better control of the surface finish of the chamfer in comparison to conventional methods and systems. As a result, cutting elements can be better tailored for given drilling applications.

Figure 7:
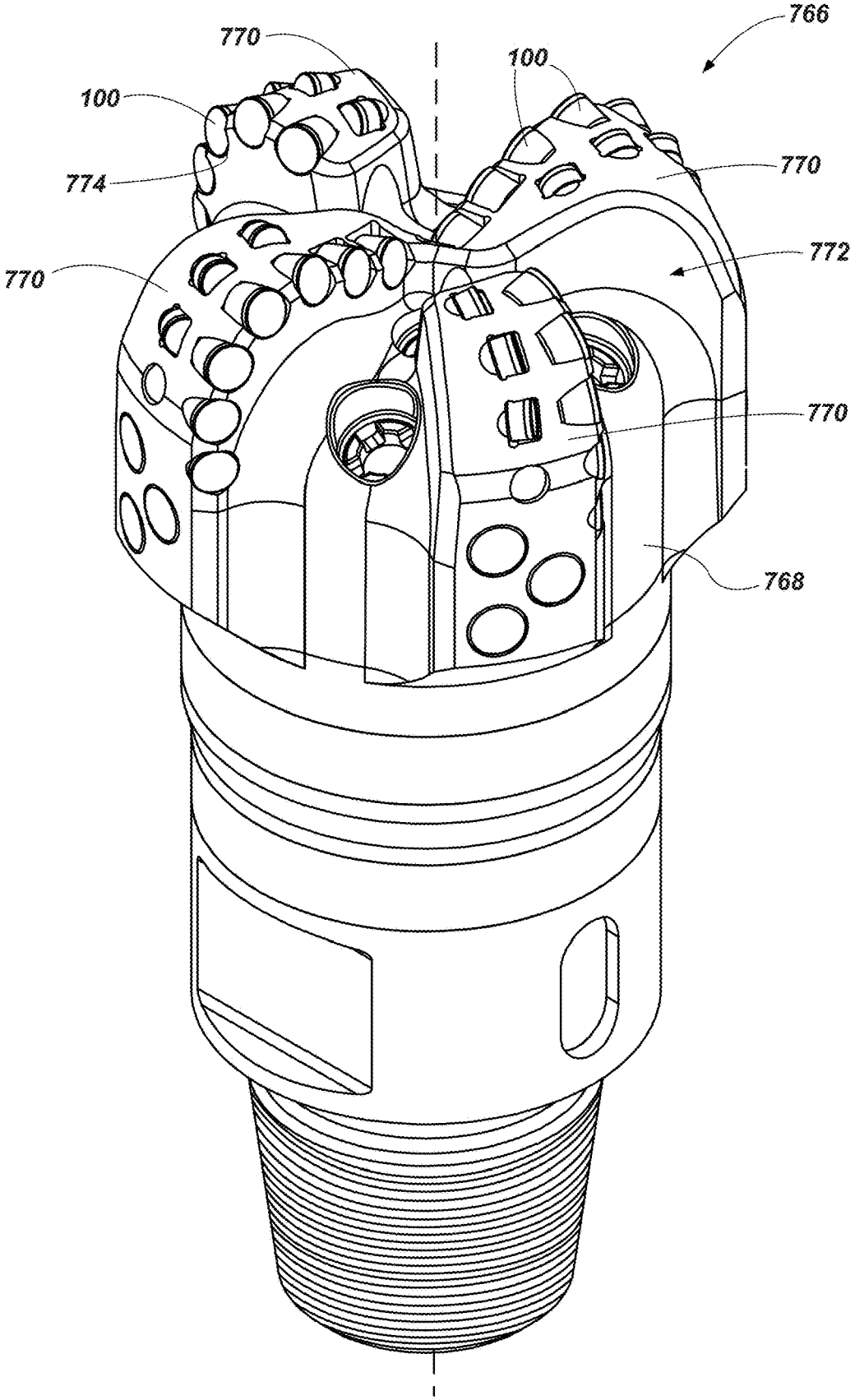
FIG. 7 is a perspective view of an earth-boring tool including one or more cutting elements in accordance with this disclosure.

FIG. 7 is a perspective view of an earth-boring tool 766 including one or more cutting elements 100 in accordance with this disclosure. The earth-boring tool 766 may include a body 768 to which the cutting element(s) 100 may be secured. The earth-boring tool 766 specifically depicted in FIG. 7 is configured as a fixed-cutter earth-boring drill bit, including blades 770 projecting outward from a remainder of the body 768 and defining junk slots 772 between rotationally adjacent blades 770. In such an embodiment, the cutting element(s) 100 may be secured partially within pockets 774 extending into one or more of the blades 770 (e.g., proximate the rotationally leading portions of the blades 770 as primary cutting elements 100, rotationally following those portions as backup cutting elements 100, or both). However, cutting elements 100 as described herein may be bonded to and used on other types of earth-boring tools, including, for example, roller cone drill bits, percussion bits, core bits, eccentric bits, bicenter bits, reamers, expandable reamers, mills, hybrid bits, and other drilling bits and tools known in the art.

Embodiments of the present disclosure further include:

Embodiment 1. A method of forming a cutting element, the method comprising: leaching at least a portion of a diamond table of the cutting element; and subsequent to leaching the diamond table of the cutting element, forming a chamfer on a leached portion of the diamond table of the cutting element proximate an interface between a cutting surface of the diamond table and an outer side surface of the diamond table.

Embodiment 2. The method of embodiment 1, wherein forming the chamfer on the diamond table comprises polishing the diamond table of the cutting element without a liquid coolant.

Embodiment 3. The method of any one of embodiments 1 or 2, wherein forming the chamfer on the diamond table comprises polishing the diamond table of the cutting element with a polishing wheel rotating at least 2440 RPM.

Embodiment 4. The method of any one of embodiments 1 through 3, wherein forming the chamfer on the diamond table comprises polishing the diamond table of the cutting element with a polishing wheel rotating at least 2800 RPM.

Embodiment 5. The method of any one of embodiments 1 through 4, wherein forming the chamfer on the diamond table comprises: polishing the diamond table of the cutting element until at least a portion of the diamond table graphitizes; and removing graphite from the diamond table by subjecting at least a portion of the diamond table to airflow.

Embodiment 6. The method of embodiment 6, wherein the airflow results from a pressure of at least 5.0 psi.

Embodiment 7. The method of any one of embodiments 6 or 7, wherein the graphite is removed from the diamond table while the diamond table disengaged from a polishing wheel.

Embodiment 8. The method of any one of embodiments 1 through 7, further comprising rotating the diamond table of the cutting element within a collet while forming the chamfer on the diamond table.

Embodiment 9. The method of embodiment 8, wherein the collet is rotated at at least 575 RPM while polishing the diamond table.

Embodiment 10. A method of forming a cutting element, the method comprising: leaching at least a portion of a diamond table; and subsequent to leaching the diamond table, polishing an interface between a cutting surface of the diamond table and an outer side surface of the diamond table to form a chamfer on the diamond table.

Embodiment 11. The method of embodiment 10, further comprising attaching the diamond table to a substrate.

Embodiment 12. The method of any one of embodiments 10 or 11, wherein leaching at least a portion of the diamond table comprised leaching the at least a portion via or more of hot acid leaching or vacuum leaching.

Embodiment 13. The method of any one of embodiments 10 through 12, wherein polishing the interface between the cutting surface of the diamond table and the outer side surface of the diamond table comprises polishing the diamond table of the cutting element without a liquid coolant.

Embodiment 14. The method of any one of embodiments 10 through 13, wherein polishing the interface between the cutting surface of the diamond table and the outer side surface of the diamond table comprises polishing the diamond table with a polishing wheel rotating at least 2440 RPM.

Embodiment 15. The method of any one of embodiments 10 through 14, wherein polishing the interface between the cutting surface of the diamond table and the outer side surface of the diamond table comprises polishing the diamond table with a polishing wheel rotating at least 2800 RPM.

Embodiment 16. The method of any one of embodiments 10 through 15, wherein polishing the interface between the cutting surface of the diamond table and the outer side surface of the diamond table: polishing the diamond table via a polishing wheel until at least a portion of the diamond table graphitizes; disengaging the diamond table from the polishing wheel; and while the diamond table is disengaged from the polishing wheel; subjecting the diamond table to airflow to remove graphitized portions of the diamond table.

Embodiment 17. The method of embodiment 16, further comprising: subsequent to removing the graphitized portions of the diamond table, reengaging the diamond table with the polishing wheel; polishing the diamond table via a polishing wheel until at least an additional portion of the diamond table graphitizes; disengaging the diamond table from the polishing wheel an additional time; and while the diamond table is disengaged from the polishing wheel; subjecting the diamond table to airflow to remove additional graphitized portions of the diamond table.

Embodiment 18. A method of forming an earth-boring tool, the method comprising: forming a cutting element comprising: leaching a diamond table of the cutting element; and subsequent to leaching the diamond table of the cutting element, forming a chamfer on the diamond table of the cutting element at an interface between a cutting surface of the diamond table and an outer side surface of the diamond table; and securing the cutting element to a body of the earth-boring tool.

Embodiment 19. The method of embodiment 18, wherein forming the chamfer on the diamond table comprises polishing the diamond table of the cutting element without a liquid coolant.

Embodiment 20. The method of any one of embodiments 18 or 19, wherein forming the chamfer on the diamond table comprises polishing the diamond table of the cutting element with a polishing wheel rotating within a range between about 2440 RPM and about 2800 RPM.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternative useful combinations of the elements described, will become apparent to those skilled in the art from the description. Such modifications and embodiments also fall within the scope of the appended claims and equivalents.

What is claimed is:

1. A method of forming a cutting element, the method comprising:

leaching at least a portion of a diamond table of the cutting element; and subsequent to leaching the diamond table of the cutting element, forming a chamfer on a leached portion of the diamond table of the cutting element proximate an interface between a cutting surface of the diamond table and an outer side surface of the diamond table by:

polishing the diamond table of the cutting element until at least a portion of the diamond table graphitizes; and removing graphite from the diamond table by subjecting at least a portion of the diamond table to airflow.

2. The method of claim 1, wherein forming the chamfer on the diamond table comprises polishing the diamond table of the cutting element without a liquid coolant.

3. The method of claim 1, wherein forming the chamfer on the diamond table comprises polishing the diamond table of the cutting element with a polishing wheel rotating at least 2440 RPM.

4. The method of claim 1, wherein forming the chamfer on the diamond table comprises polishing the diamond table of the cutting element with a polishing wheel rotating at least 2800 RPM.

5. The method of claim 1, further comprising attaching the diamond table to a substrate.

6. The method of claim 1, wherein the airflow results from a pressure of at least 5.0 psi.

7. The method of claim 1, wherein the graphite is removed from the diamond table while the diamond table is disengaged from a polishing wheel.

8. The method of claim 1, further comprising rotating the diamond table of the cutting element within a collet while forming the chamfer on the diamond table.

9. The method of claim 8, wherein the collet is rotated at at least 575 RPM while polishing the diamond table.

10. A method of forming a cutting element, the method comprising:

leaching at least a portion of a diamond table; and subsequent to leaching the at least a portion of the diamond table, polishing an interface between a cutting surface of the diamond table and an outer side surface of the diamond table to form a chamfer on the diamond table, polishing the interface between the cutting surface of the diamond table and the outer side surface of the diamond table comprises:

polishing the diamond table via a polishing wheel until at least a portion of the diamond table graphitizes;

disengaging the diamond table from the polishing wheel; and while the diamond table is disengaged from the polishing wheel, subjecting the diamond table to airflow to remove graphitized portions of the diamond table.

11. The method of claim 10, further comprising attaching the diamond table to a substrate.

12. The method of claim 10, wherein leaching at least a portion of the diamond table comprised leaching the at least a portion via one or more of hot acid leaching or vacuum leaching.

13. The method of claim 10, wherein polishing the interface between the cutting surface of the diamond table and the outer side surface of the diamond table comprises polishing the diamond table of the cutting element without a liquid coolant.

14. The method of claim 10, wherein polishing the interface between the cutting surface of the diamond table and the outer side surface of the diamond table comprises polishing the diamond table with a polishing wheel rotating at least 2440 RPM.

15. The method of claim 10, wherein polishing the interface between the cutting surface of the diamond table and the outer side surface of the diamond table comprises polishing the diamond table with a polishing wheel rotating at least 2800 RPM.

16. The method of claim 10, further comprising:

subsequent to removing the graphitized portions of the diamond table, reengaging the diamond table with the polishing wheel;

polishing the diamond table via the polishing wheel until at least an additional portion of the diamond table graphitizes;

disengaging the diamond table from the polishing wheel an additional time; and while the diamond table is disengaged from the polishing wheel, subjecting the diamond table to airflow to remove additional graphitized portions of the diamond table.

17. A method of forming an earth-boring tool, the method comprising:

forming a cutting element comprising:

leaching at least a portion of a diamond table of the cutting element; and subsequent to leaching the diamond table of the cutting element, forming a chamfer on the diamond table of the cutting element at an interface between a cutting surface of the diamond table and an outer side surface of the diamond table by:

polishing the diamond table of the cutting element until at least a portion of the diamond table graphitizes; and removing graphite from the diamond table by subjecting at least a portion of the diamond table to airflow; and securing the cutting element to a body of the earth-boring tool.

18. The method of claim 17, wherein forming the chamfer on the diamond table comprises polishing the diamond table of the cutting element without a liquid coolant.

19. The method of claim 17, wherein forming the chamfer on the diamond table comprises polishing the diamond table of the cutting element with a polishing wheel rotating within a range between about 2440 RPM and about 2800 RPM, wherein about 2440 RPM includes the value of 2440 RPM and a degree of error associated with measurement of rotation of the polishing wheel, and about 2800 RPM includes the value of 2800 RPM and the degree of error associated with measurement of rotation of the polishing wheel.

20. A method of forming an earth-boring tool, the method comprising:

forming a cutting element comprising:

leaching at least a portion of a diamond table; and subsequent to leaching the at least a portion of the diamond table, polishing an interface between a cutting surface of the diamond table and an outer side surface of the diamond table to form a chamfer on the diamond table, polishing the interface between the cutting surface of the diamond table and the outer side surface of the diamond table comprises:

polishing the diamond table via a polishing wheel until at least a portion of the diamond table graphitizes;

disengaging the diamond table from the polishing wheel; and while the diamond table is disengaged from the polishing wheel, subjecting the diamond table to airflow to remove graphitized portions of the diamond table; and securing the cutting element to a body of the earth-boring tool.

* * * * *